US007905490B2

(12) United States Patent
Rehkemper et al.

(10) Patent No.: US 7,905,490 B2
(45) Date of Patent: Mar. 15, 2011

(54) INTERACTIVE GAME AND METHOD OF PLAY

(75) Inventors: Jeffrey Rehkemper, Chicago, IL (US); Daniel Kim, Portland, OR (US); Kerry Phillips, South Holland, IL (US)

(73) Assignee: Rehco, LLC, Chicago, IL (US)

( * ) Notice: Subject to any disclaimer, the term of this patent is extended or adjusted under 35 U.S.C. 154(b) by 108 days.

(21) Appl. No.: 12/200,157

(22) Filed: Aug. 28, 2008

(65) Prior Publication Data

US 2009/0206549 A1 Aug. 20, 2009

Related U.S. Application Data

(60) Provisional application No. 60/968,581, filed on Aug. 29, 2007.

(51) Int. Cl.
*A63F 1/00* (2006.01)

(52) U.S. Cl. ..... 273/429; 273/308

(58) Field of Classification Search ..... 273/292, 273/429–432, 308

See application file for complete search history.

(56) References Cited

U.S. PATENT DOCUMENTS

| | | | | | |
|---|---|---|---|---|---|
| 3,524,645 | A * | 8/1970 | Breslow | 273/292 |
| 4,315,627 | A * | 2/1982 | Schlegel et al. | 273/249 |
| 4,421,310 | A * | 12/1983 | Williams | 273/143 R |
| 4,566,698 | A | 1/1986 | Sneden | |
| 5,184,821 | A * | 2/1993 | Korenek | 273/138.2 |
| 5,288,075 | A * | 2/1994 | Kelley | 273/243 |
| 6,648,331 | B2 | 11/2003 | Stuart | |
| 7,029,281 | B1 | 4/2006 | Rathyen | |
| 7,270,329 | B2 * | 9/2007 | Barthold | 273/276 |
| 2006/0038345 | A1 * | 2/2006 | Barthold | 273/273 |

OTHER PUBLICATIONS

Guess What I Am, from www.technosourceusa.com, 2010.*
http://boardgamegeek.com/image/410714/pie-face, 1964.*
http://boardgamegeek.com/boardgame/1268/whats-that-on-my-head, 1960.*
http://boardgamegeek.com/boardgame/33406/who-am-i, 2010.*
http://boardgamegeek.com/boardgame/12539/amnesia, 1990.*

* cited by examiner

*Primary Examiner* — William M Pierce
(74) *Attorney, Agent, or Firm* — Adam K. Sacharoff; Much Shelist

(57) ABSTRACT

A multi-player interactive card game, preferably having character cards with images of people with different occupations and different types of animals. An oval face cutout is included on each of the character cards. Game play involves impersonations and guessing along with prompts for players to raise and position the character cards such that a player's face completes a visual image of the identity of the character card.

16 Claims, 7 Drawing Sheets

INTERACTIVE GAME AND METHOD OF PLAY

CROSS REFERENCE TO RELATED APPLICATIONS

The present application claims priority to U.S. Provisional Application 60/968,581 filed Aug. 29, 2007.

FIELD OF THE INVENTION

The present invention relates to a multi-player interactive game, and in particular to a game including different character cards where each character card includes an oval cutout sized to accommodate a player's face. Game play prompts players to raise and position the character cards such that a player's face completes a visual image of the identity of the character card.

BACKGROUND OF THE INVENTION

Numerous multi-player games have been around for years. One popular game is called blind man's bluff or Indian poker. In this card game, each player is dealt one card that they cannot look at. The player must place the card on their forehead so that everyone else can see the card. The dealer begins by betting that he has the highest card. Players who do not think they can win fold. The player who ends up wining has the highest card. While variations to this game may exist, there is no real ability to play this game outside the use of a deck of cards. The present invention is directed to a similar game that employs numerous face cards and other rules that make the game interesting and fun for children and adults of all ages.

SUMMARY OF THE INVENTION

A game is provided in accordance with an embodiment of the present invention as being directed to a game having multiple rounds of turns, for at least two players. The game includes a plurality of oversized cards. Each card having an opening sized to accommodate a face of a player and each card having at least one side with an identifiable character. Each player receives at least one of the oversized cards at the beginning of the game such that each player is unaware of the identifiable character on its corresponding oversized card. The game includes a multi-sided die, each side of the die indicates to a player a specific option on how to play a round or turn. The game further includes a set of rules for game play to direct the players to roll the multi-sided die, wherein the side of the die indicates to a player on how to play the round. The die includes a side that directs the player to ask the at least one other player questions about the identifiable character on its corresponding oversized card placed in front of its face, and the set of rules direct a player to win the game by correctly guessing the identifiable character on its corresponding oversized card.

In alternative embodiments, the multi-sided die further includes an option that directs a player to lose a turn during the round; directs the round to reverse an order of play among the at least two players; or permits a player to guess the identification of the character of its corresponding oversized card and wherein the set of rules for game play dictate that a player is unable to make a guess until the multi-sided die lands of the guess option.

Other embodiments include a tally sheet including a listing of various characters and the set of rules for game play permit players to mark off characters in response to questions asked about its corresponding identifiable character until the player correctly guesses its corresponding identifiable character. The game may also include a plurality of game chips and the set of rules for game play direct a player correctly guessing its corresponding identifiable character to collect a game chip and the set of rules for game play further directing the players to select another oversized card after a player correctly guesses its corresponding identifiable character until a player collects a predetermined number of game chips.

In yet another embodiment, the game further includes a plurality of frames, each frame having a window sized to accommodate the oversized card and each frame having a boarder with a location image, and the set of rules for game play direct the players to select a frame for each oversized card and correctly guess its identifiable character on its corresponding oversized card and correctly guess the location image on the corresponding frame.

In other embodiments, a game is provided with a plurality of oversized cards and a set of rules for game play. Each card having an opening sized to accommodate a face of a player and each card having at least one side with an identifiable character, each player to receive at least one of the oversized cards such that each player is unaware of the identifiable character on its corresponding oversized card. The set of rules for game play direct the players to take turns asking the at least one other player questions about the identifiable character on its corresponding oversized card placed in front of its face, and the set of rules direct a player to win the game by correctly guessing the identifiable character on its corresponding oversized card.

Numerous advantages and features of the invention will become readily apparent from the following detailed description of the invention and the embodiments thereof, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
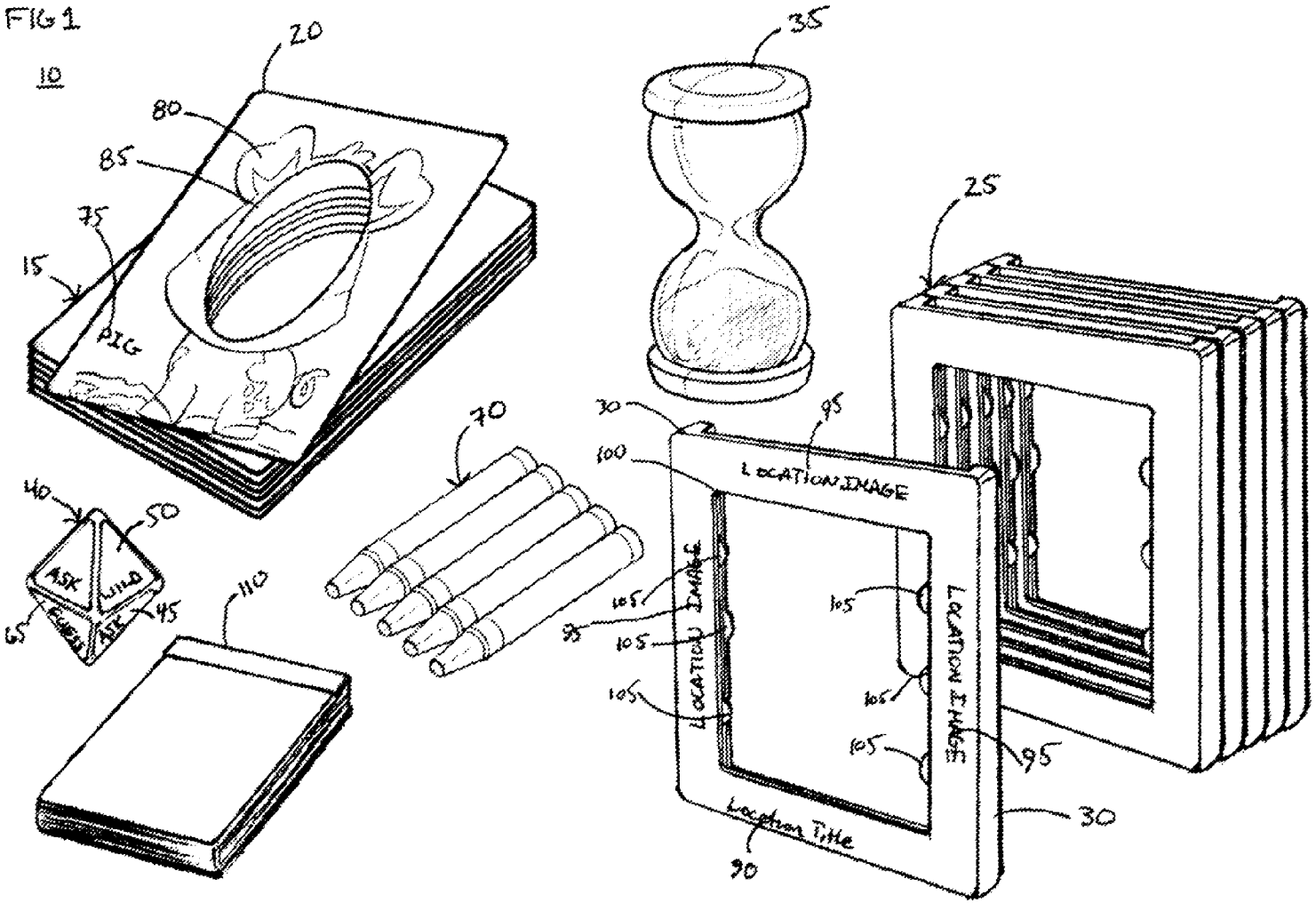
FIG. 1 is an illustrative view of one embodiment of a game in accordance with the present invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the claims by the embodiments illustrated.

Referring now to FIG. 1, there is illustrated a game 10 in accordance with one embodiment of the present invention. The game 10 includes a character card set 15 containing a plurality of character cards 20 with a means to incorporate players' faces with game play. While forty to fifty character cards 20 are preferred, virtually any number of character cards 20 may be included in the card set 15 for game play. Further, the game 10 includes a frame set 25 containing a plurality of location frames 30 with a means to incorporate the character cards 20 and a player's face with game play. While ten to twenty location frames 30 are preferred, virtually any number of location frames 30 may be included in the frame set 25.

The game 10 may also include a timer 35 that is used to incorporate a desired time frame for certain types of game play (described below). In a preferred embodiment, the timer 35 would provide a visual and/or audio signal upon the expiration of a predetermined fixed time period, shown in this embodiment as a traditional sand hourglass. Other embodiments of devices performing the function of the timer 35 are possible and well known in the art and may be supplied by the players. The game 10 also preferably includes a multi-sided die 40 that is rolled for a player to receive gaming direction.

Figure 2A:
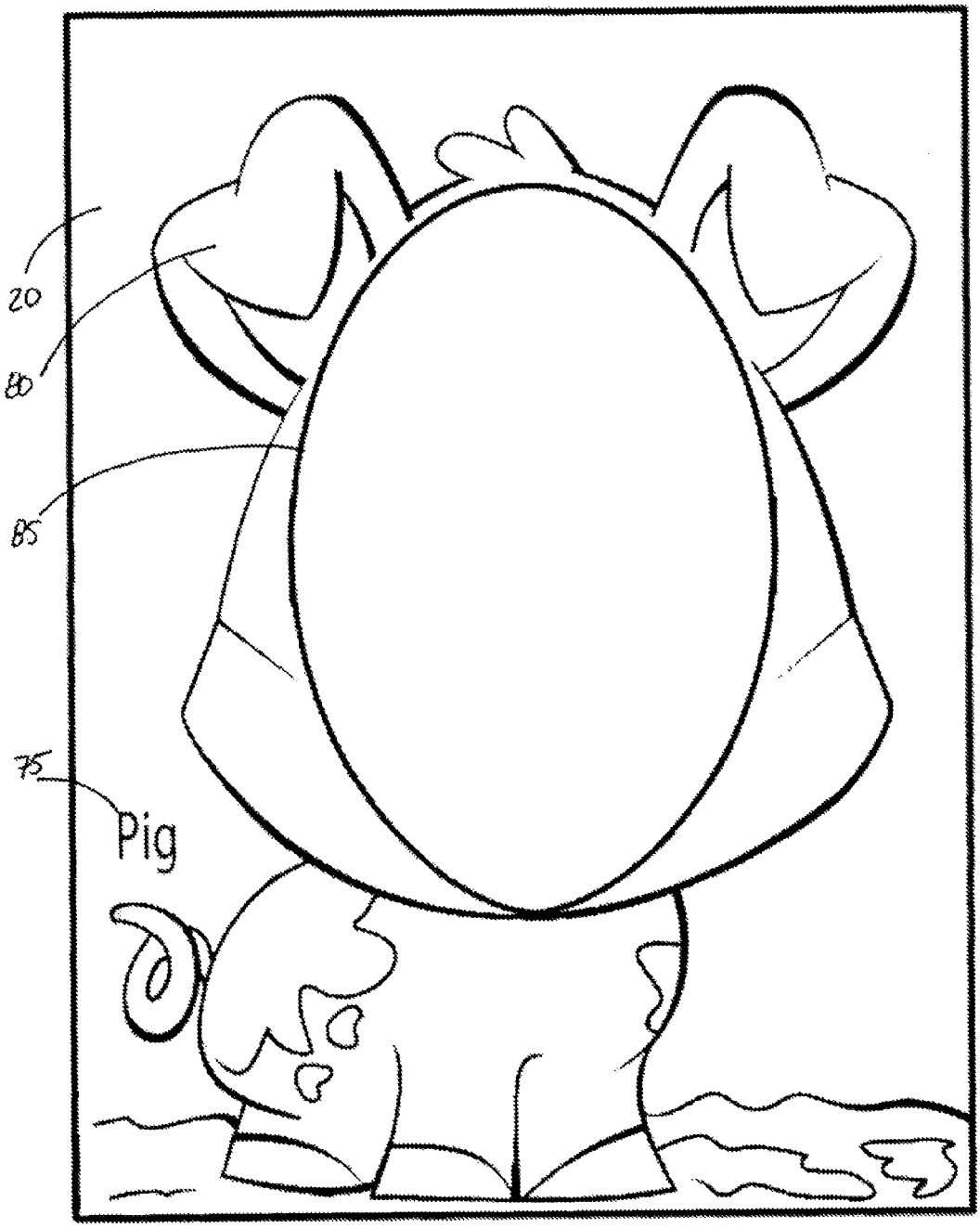
FIG. 2*a* is a front view of a first example of a character card.
Figure 2B:
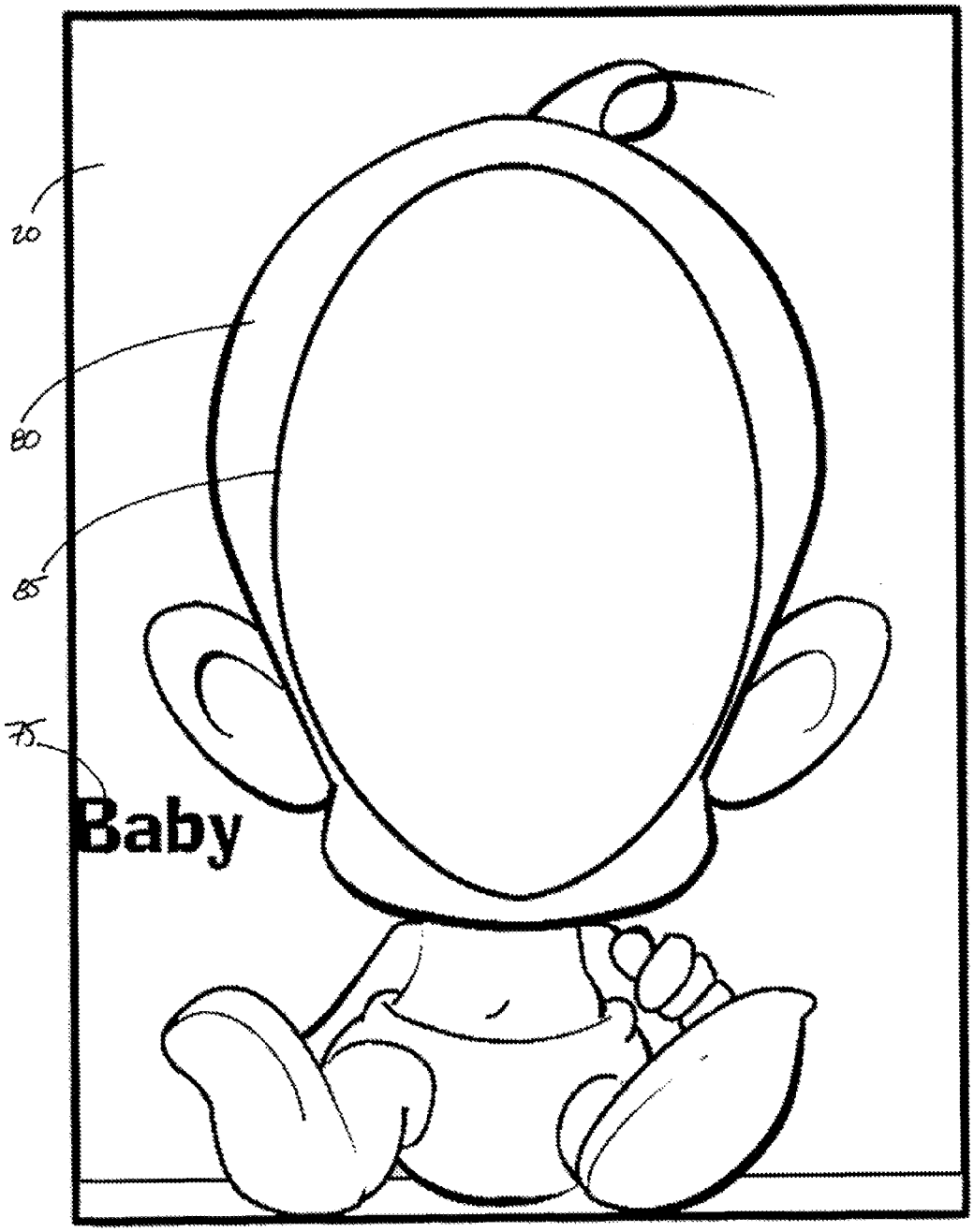
FIG. 2*b* is a front view of a second example of a character card.
Figure 3:
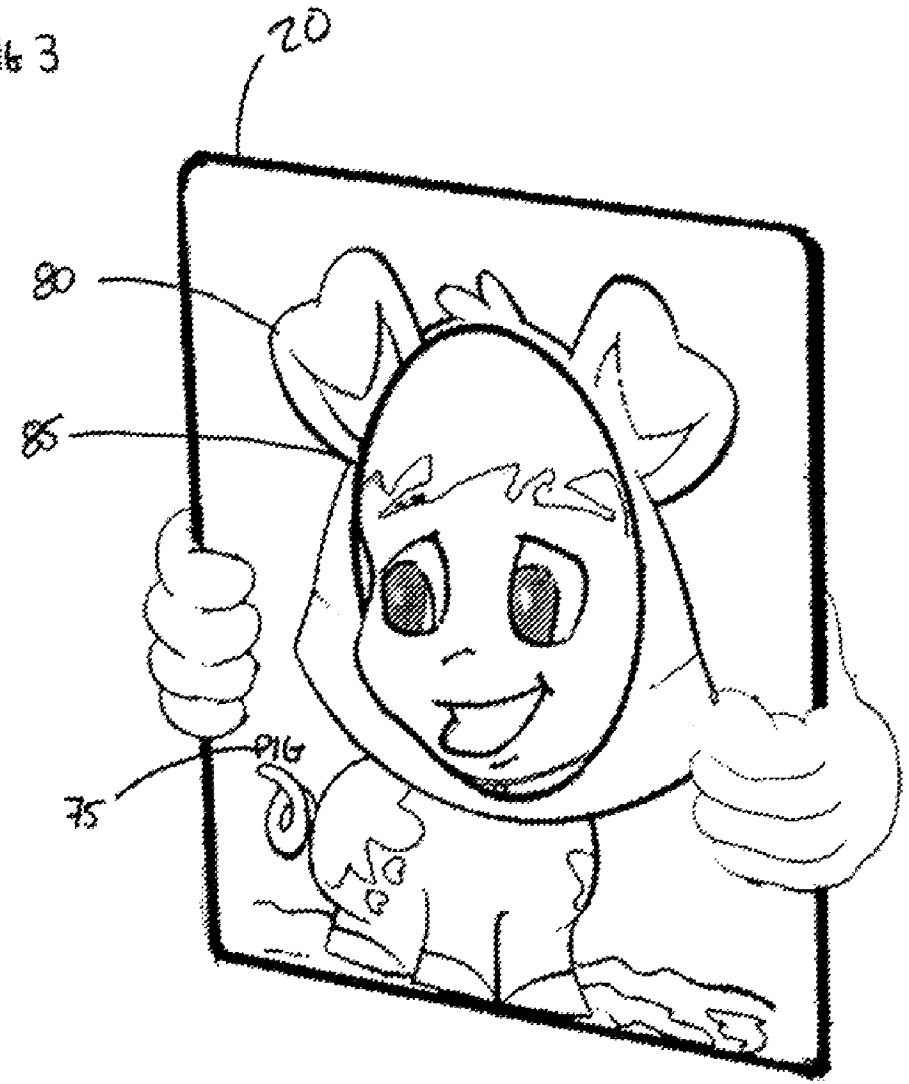
FIG. 3 is an illustrative view of a character card during game play where a player's face is positioned in an oval face cutout.

Referring now to FIGS. 2*a* and 2*b*, two examples of a character card 20 are illustrated. The character card 20 includes an identity title 75, an identity image 80 and an oval face cutout 85 in the identity image 80. The cards 20 may be oversized such that the cutout or opening easily accommodates a players face. During some examples of game play (described below), the game 10 includes a means to prompt a player to raise and position their character card 20 such that the player's face is in the oval face cutout 85 as shown in FIG. 3. The result is a humorous and entertaining visual experience where a player's face completes the identity image 80 of the character card 20. There is virtually no limitation on the nature of the identity image 80. Examples of identity images 80 may include animals, people, mythical creatures, etc. In addition, to expand game play, the game 10 may include a set of laminated blank character cards such that a player may create a unique and new character card utilizing a dry-erase marker or other erasable writing utensil.

Figure 4B:
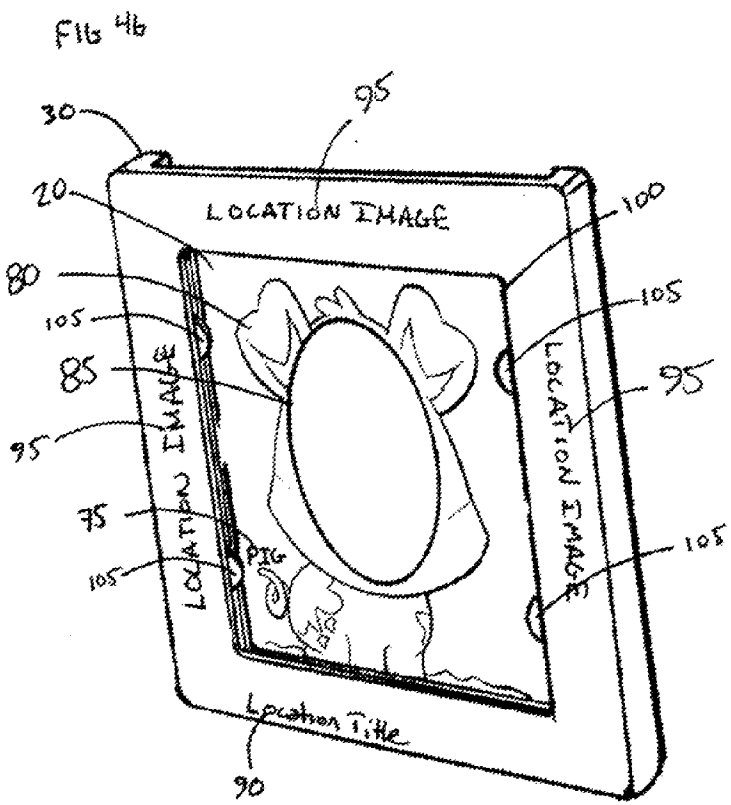
FIG. 4*b* is an illustrative view of one example of a location frame with a character card inserted.
Figure 4A:
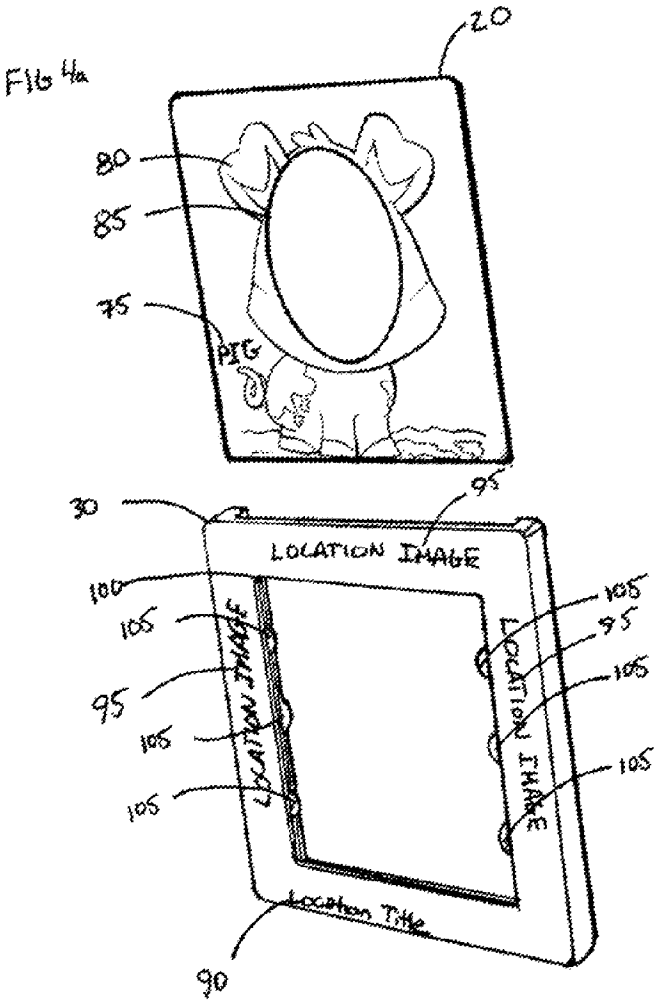
FIG. 4*a* is an illustrative view of one example of a location frame and character card, prior to insertion.
Figure 5:
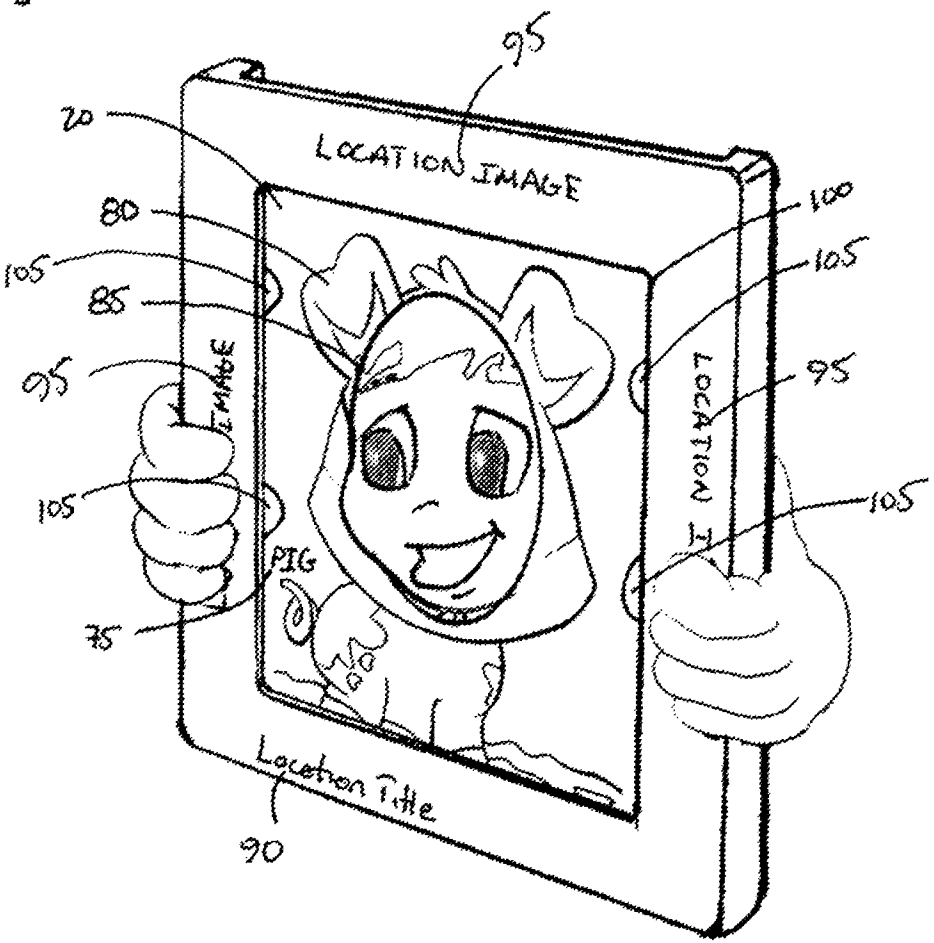
FIG. 5 is an illustrative view of a character card inserted in a location frame during game play where a player's face is positioned in an oval face cutout.

FIGS. 4*a* and 4*b* show an example of a location frame 30. The location frame 30 includes a location title 90, a location image 95, a rectangular cutout 100 and a plurality of tabs 105 to removably secure a character card 20 in position for additional game play options. During some examples of game play (described below), the game 10 includes a means to prompt a player to insert their character card 20 between the tabs 105 and the location frame 30 as shown in FIG. 4*b*, then raise and position the character card 20 and the location frame 30 such that the player's face is in the oval face cutout 20 as shown in FIG. 5. The result is a humorous and entertaining visual experience where a player's face completes the identity image 80 of the character card 20 while the location frame 30 enhances the game play by providing a location background. Examples of location images 95 may include tropical destinations, workplaces, urban or rural settings, etc.

Figure 6A:
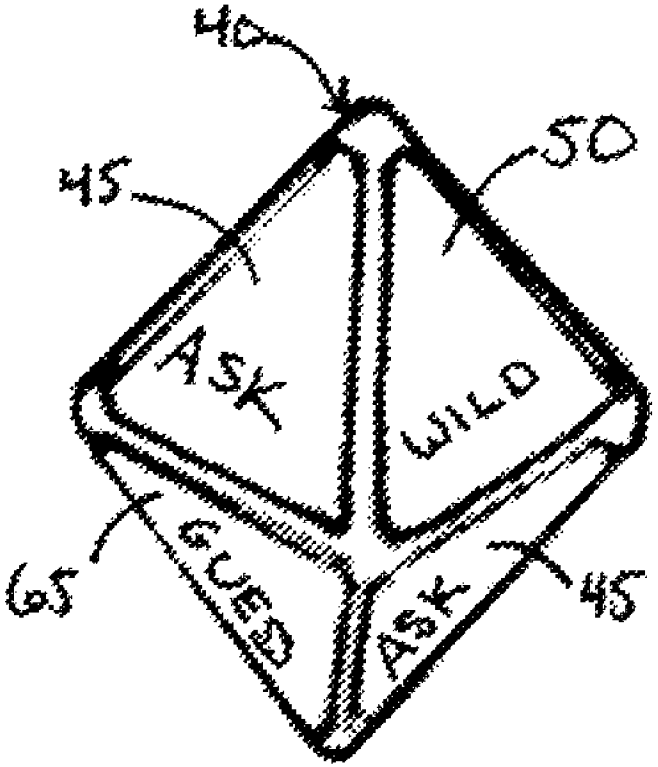
FIG. 6*a* is an illustrative view of the front side of an eight-sided die.
Figure 6B:
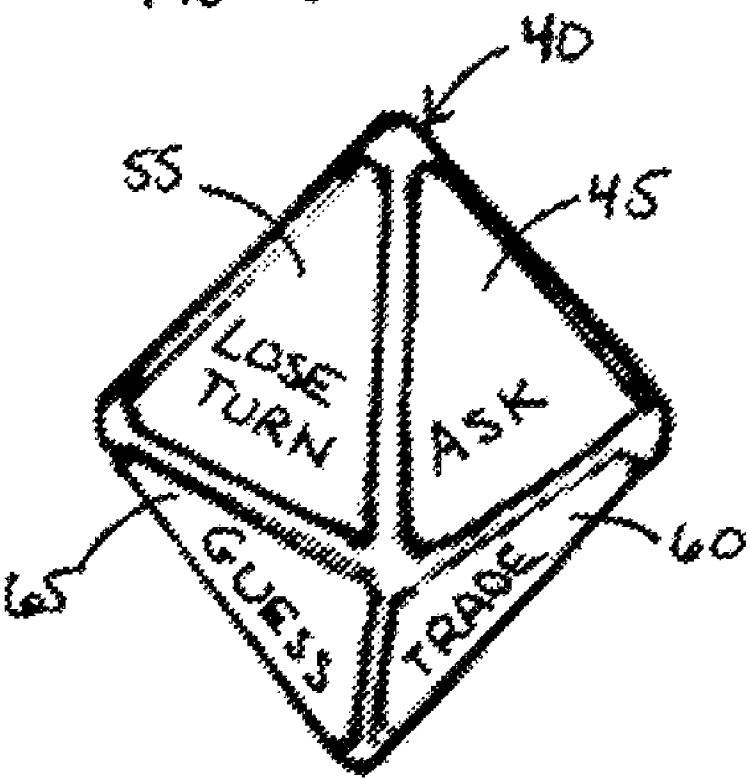
FIG. 6*b* is an illustrative view of the rear side of an eight-sided die.

FIGS. 6*a* and 6*b* show an eight-sided die 40 that includes three "Ask" sides 45, one "Wild" side 50, one "Lose Turn" side 55, one "Trade" side 60 and two "Guess" sides 65. A description of how the different sides direct game play is included below. While the use of a die is described in one embodiment, other devices capable of performing the function of directing play are possible and well know in the art.

Referring back to FIG. 1, a set of writing utensils 70 are also provided as part of the game 10, preferably crayons. Other types of writing utensils may be used as the type of writing utensil is not meant to limit the scope of the present invention. Further, a tally pad 110 is included in the game 10. Each sheet of the tally pad 110 preferably includes an illustration or list with all of the identity images 80 or identity titles 75 from the character card set 15. Players use sheets from the tally pad 110 to record progress during game play (described below). Additionally, game chips may be distributed to players in accordance to points awarded during game play. The method of game play may best be understood by the following examples.

FIRST EXAMPLE OF GAME PLAY

Who am I?

In a first example of game play for two or more players, the object is for each player to acquire points by determining the identity title 75 of a drawn character card 20, without seeing the character card 20, but by using the process of elimination to ask a series of "yes" and "no" questions to the other players. The first player to obtain a predetermined number of points wins.

To start play, the players agree upon the number of points associated with correct guesses required to win. Each player draws a character card 20 and places the character card 20 face down. The players then raise and position their respective character card 20 so their face is in the oval cutout 85, such that each player can see the identity title 75 of the other players' character cards 20.

The player selected to go first rolls the eight-sided die 40 and follows the direction displayed on the die 40 (as described above). If the die 40 lands on ASK, the rolling player may ask one "yes" or "no" question to help eliminate possible identities from the field of choices. For example, if the rolling player asks, "Do I have red hair?" and the other players answer "no," the rolling player limits the field of possibilities by crossing out identities on a sheet from the tally pad 110 that have red hair. The first player to roll GUESS and correctly guess the identity title 75 of their character card 20 wins the round and an associated point value. The first player to obtain the predetermined number of points wins the game.

SECOND EXAMPLE OF GAME PLAY

Team Challenge

In a second example of game play, the object is for teams to acquire points by assisting a teammate that cannot see their character card 20 to determine the identity title 75 of their character card 20. The teams' players alternate drawing character cards 20 and guessing until a predetermined point total is acquired.

To start play, one player from the starting team draws a character card 20 without looking at the identity of the character card 20. The drawing player raises and positions the character card 20 such that their face is in the oval cutout 85. The drawing player utilizes clues from teammates to guess the identity title 75 of the drawn character card 20. Though there are numerous rule variations possible, the teammates preferably give clues that do not use words included in the identity title 75 of the character card 20 and also set a predetermined limit on the number of clues.

A team receives points for a correct guess. The drawn character card 20 is then placed in a discard pile if the predetermined on the number of clues is reached, alternating between the teams, as above. The first team to earn the predetermined point total wins.

THIRD EXAMPLE OF GAME PLAY

Charades

In a third example of game play, the object is for players to acquire points by impersonating and guessing the identity titles 75 of drawn character cards 20. Points are awarded for correctly guessing the identity title 75 of the drawn character card 20 and to the player whose impersonation led to the correct guess until a predetermined point total is acquired.

To start play, the starting player draws a character card 20, keeping the identity from the other players. The drawing player impersonates the character card 20 for the other players without utilizing speech. The player to the left has one chance to guess. If incorrect, the next subsequent player to the left has one chance to guess and play proceeds in the same fashion until the identity title 75 is guessed correctly. A correct guess ends the round, and the player to the left of the drawing player then draws a character card 20. Points are awarded accordingly. The points are recorded on a sheet from the tally pad 110 and the first player to earn the predetermined point total wins.

FOURTH EXAMPLE OF GAME PLAY

Speed Charades

In a fourth example of game play, the object is for a players to acquire points by impersonating and guessing the identity titles 75 of drawn character cards 20 within a predetermined time frame. Points are awarded for correctly guessing the identity title 75 of the drawn character card 20 and to the player whose impersonation led to the correct guess. The first player to earn a predetermined point total wins.

To start play, the starting player draws a character card 20, keeping the identity from the other players while simultaneously starting the timer 35. The drawing player impersonates the character card 20 for the player to the drawing player's left without utilizing speech. A correct guess within the allocated time earns points for the guessing player and points for the impersonating player. If time expires without a correct guess, all of the other players earn points. Play continues in a clockwise fashion. The points are recorded on a sheet from the tally pad 110 and the first player to earn the predetermined point total wins.

FIFTH EXAMPLE OF GAME PLAY

Lightning Round

In a fifth example of game play, the object is for teams to acquire points by assisting teammates to determine the identity title 75 of their character card 20 in a continuous sequence before a predetermined time expires. The first team to earn a predetermined point total wins.

To start play, the character cards 20 are divided equally amongst the teams. The character cards 20 are distributed to each of the players, such that the identities are not revealed. A player from the starting team raises and positions a character card 20 such that their face is in the oval cutout 85 for their teammates to view while the timer is simultaneously started. The teammates give clues about the player's character card 20 to assist the player in correctly guessing the identity title 75. Though numerous rule variations are possible, the teammates preferably give clues that do not use words included in the identity title 75 of the character card 20. Each correct guess prompts the next player to the left to raise and position a new character card 20 as above and again attempts to guess the identity title 75 of their character card 20 based on clues from teammates. Play continues in this fashion while the team acquires points for correct guesses during the predetermined time frame. At the end of the predetermined time frame, the opposing team starts accordingly and in the same fashion as above.

Points are assigned to the number of correct guesses from round one. For round two, the character cards 20 are reshuffled, distributed, and play continues in the same manner as round one. Points are assigned to the number of correct guesses from round two and are added to the points from round one to determine a winner. While this example used two rounds, the players may determine the number of rounds prior to starting play.

There is a virtually unlimited amount of play patterns that can be included in the game play. The examples above are meant to be but a few of the many and are not meant to limit the invention in any manner.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred by the embodiment or by the claims presented herein.

We claim:

1. A game, having multiple rounds of turns, for at least two players comprising:

a plurality of oversized cards, each card having an opening sized to accommodate a face of a player and each card having at least one side with an identifiable character, each player to receive at least one of the oversized cards at the beginning of the game such that each player is unaware of the identifiable character on its corresponding oversized card;

a multi-sided die, each side of the die indicating to a player a specific option on how to play a round; and a set of rules for game play to direct the players to roll the multi-sided die;

a tally sheet including a listing of various characters and the set of rules for game play permit players to mark off characters in response to questions asked about its corresponding identifiable character, wherein the side of the die indicates to a player on how to play the round including a side that directs the player to ask the at least one other player questions about the identifiable character on its corresponding oversized card placed in front of said face of said player, and the set of rules direct a player to win the game by correctly guessing the identifiable character on its corresponding oversized card.

2. The game of claim 1, wherein one of the each side of the die further includes an option that directs a player to lose a turn during the round.

3. The game of claim 1, wherein one of the each side of the die further includes an option that directs the round to reverse an order of play among the at least two players.

4. The game of claim 1, wherein one of the each side of the die further includes an option that permits a player to guess the identification of the character of its corresponding oversized card and wherein the set of rules for game play dictate that a player is unable to make a guess until the multi-sided die lands of said option.

5. The game of claim 4 further comprising a plurality of game chips and the set of rules for game play direct a player correctly guessing its corresponding identifiable character to collect a game chip and the set of rules for game play further directing the players to select another oversized card after a player correctly guesses its corresponding identifiable character until a player collects a predetermined number of game chips.

6. The game of claim 5 further comprising a plurality of frames, each frame having a window sized to accommodate the oversized card and each frame having a boarder with a location image, and the set of rules for game play direct the players to select a frame for each oversized card and correctly guess its identifiable character on its corresponding oversized card and correctly guess the location image on the corresponding frame.

7. A game comprising:

a plurality of oversized cards, each card having an opening sized to accommodate a face of a player and each card having at least one side with an identifiable character, each player to receive at least one of the oversized cards such that each player is unaware of the identifiable character on its corresponding oversized card;

a set of rules for game play to direct the players to take turns asking the at least one other player questions about the identifiable character on its corresponding oversized card placed in front of said face of said player; and a plurality of frames, each frame having a window sized to accommodate the oversized card and each frame having a boarder with a location image, and the set of rules for game play direct the players to select a frame for each oversized card and correctly guess its identifiable character on its corresponding oversized card and correctly guess the location image on the corresponding frame.

8. A method of playing a game comprising:

providing a plurality of character cards, each of the character cards having an oval cutout sized to accommodate a player's face and having an identifiable character on at least one side, and placing said plurality of character cards face down such that the identifiable character are hidden from the plurality of players;

each of the players, of the plurality of players, selecting an identifiable character and placing the plurality of character cards in front of the face of the player;

directing the players to take turns asking the at least one other player a question about the identifiable character on the corresponding character card placed in front of said face of said player; and winning the game by correctly guessing the identifiable character on the corresponding character card.

9. The method of claim 8 further comprising rolling a multi-sided die, wherein each side of the die indicating to a player a specific option on how to play a turn, including asking a question, losing a turn, reversing direction of play, and guessing the identifiable character.

10. The method of claim 9 further comprising:

providing a plurality of frames, each frame having a window sized to accommodate the character card and each frame having at least one side with a boarder showing a location image, and placing said plurality of frames face down such that the location images are hidden from the plurality of players;

each of the players, of the plurality of players, selecting frame with a character card and placing the character card into the frame; and directing the players to take turns asking the at least one other player a question about the identifiable character on the corresponding character card and/or about the location image on the corresponding frame placed in front of said face of said player; and winning the game by correctly guessing the identifiable character on the corresponding character card and by correctly guessing the location image of the corresponding frame.

11. A game, having multiple rounds of turns, for at least two players comprising:

a plurality of oversized cards, each card having an opening sized to accommodate a face of a player and each card having at least one side with an identifiable character, each player to receive at least one of the oversized cards at the beginning of the game such that each player is unaware of the identifiable character on its corresponding oversized card;

a multi-sided die, each side of the die indicating to a player a specific option on how to play a round; and a set of rules for game play to direct the players to roll the multi-sided die, wherein the side of the die indicates to a player on how to play the round including a side that directs the player to ask the at least one other player questions about the identifiable character on its corresponding oversized card placed in front of said face of said player; and a plurality of frames, each frame having a window sized to accommodate the oversized card and each frame having a boarder with a location image, and the set of rules for game play direct the players to select a frame for each oversized card and correctly guess its identifiable character on its corresponding oversized card and correctly guess the location image on the corresponding frame.

12. The game of claim 11 further comprising a tally sheet including a listing of various characters and the set of rules for game play permit players to mark off characters in response to questions asked about its corresponding identifiable character.

13. The game of claim 11, wherein one of the each side of the die further includes an option that directs a player to lose a turn during the round.

14. The game of claim 11, wherein one of the each side of the die further includes an option that directs the round to reverse an order of play among the at least two players.

15. The game of claim 11, wherein one of the each side of the further includes an option that permits a player to guess the identification of the character of its corresponding oversized card and wherein the set of rules for game play dictate that a player is unable to make a guess until the multi-sided die lands of said option.

16. The game of claim 11 further comprising a plurality of game chips and the set of rules for game play direct a player correctly guessing its corresponding identifiable character to collect a game chip and the set of rules for game play further directing the players to select another oversized card after a player correctly guesses its corresponding identifiable character until a player collects a predetermined number of game chips.

* * * * *